US005601519A

United States Patent [19]

Comereski

[11] Patent Number: 5,601,519

[45] Date of Patent: Feb. 11, 1997

[54] ABDOMINAL EXERCISING MACHINE

[76] Inventor: John S. Comereski, 113 Halloran Dr., P.O. Box 401, Breesport, N.Y. 14816

[21] Appl. No.: 561,456

[22] Filed: Nov. 21, 1995

[51] Int. Cl.[6] ..... A63B 23/02

[52] U.S. Cl. ..... 482/142; 482/130; 606/242; 601/24

[58] Field of Search ..... 601/24, 23, 115, 601/116; 606/247, 241, 235, 242, 240; 482/141, 142, 130, 123; 5/615, 614

[56] References Cited

U.S. PATENT DOCUMENTS

| | | | |
|---|---|---|---|
| 1,158,779 | 11/1915 | Bolger | 601/24 |
| 2,264,046 | 11/1941 | McClellan . | |
| 2,520,849 | 8/1950 | McVicker | 5/614 |
| 4,144,880 | 3/1979 | Daniels | 606/242 |
| 4,207,635 | 6/1980 | Leroy . | |
| 4,307,880 | 12/1981 | Abram . | |
| 4,489,936 | 12/1984 | Dal Monte . | |
| 4,669,139 | 6/1987 | Richter, Jr. | 5/615 |
| 5,099,831 | 3/1992 | Freed . | |
| 5,170,522 | 12/1992 | Walker | 5/615 |
| 5,205,804 | 4/1993 | Hall . | |
| 5,232,426 | 8/1993 | Van Straaten . | |
| 5,458,549 | 10/1995 | Obery | 482/142 |

FOREIGN PATENT DOCUMENTS

| | | |
|---|---|---|
| 0208208 | 1/1987 | Germany . |
| 2192343 | 1/1988 | United Kingdom . |

*Primary Examiner*—Jerome Donnelly
*Attorney, Agent, or Firm*—Richard C. Litman

[57] ABSTRACT

An apparatus for exercising the abdominal and other muscles associated with full flexure of the lower and middle spine made up of four main components: (1) an inclined base, (2) a collapsible platform, (3) pivotally connected support members which elevate the collapsible platform above the base and allow the platform to transform from a resting state to a collapsed state, and (4) a resistance mechanism preventing the collapse of the platform and associated support members and resisting appropriately placed forces exerted by the lower back against the platform. The platform is defined by three sections, a head-end section, a middle section, and a leg-end section, attached in such a manner that the head-end section and leg-end section can collapse about the middle section throughout a range of positions wherein end-positions are defined by a resting state and a collapsed state. A generally W-shaped carriage for riding a convex incline of the base allows the middle section to sink and associated support members forced vertically upward to raise the associated head-end and leg-end sections. The resistance mechanism resists the collapse of the middle section.

17 Claims, 5 Drawing Sheets

52
66
54
60
64
52
58
62
56
40

ABDOMINAL EXERCISING MACHINE

BACKGROUND OF THE INVENTION

1. Field of the Invention

The present invention relates to an apparatus for exercising the abdominal and other muscles associated with full flexure of the lower spine.

2. Description of the Prior Art

Proper exercising of the abdominal muscles to obtain maximal results is a concern Of a large number of fitness enthusiasts; yet the mechanics of proper exercising are rarely fully understood. The present invention eliminates the need for an exercising individual to understand muscle mechanics in order to maximize exercising effects.

Muscles are obviously intended to cause motion of a skeletal frame. Therefore, exercise is naturally limited by the ability of the bones of joint to move through the joint's maximal range of motion. Conversely, to maximize the exercise of all groups of muscles associated with a joint, the bones must be taken through their entire range of motion. If not fully utilized, muscle groups may be entirely unused or ineffectively exercised.

This concept is particularly evident when examining the mechanics of the human spine, which has a maximal total range of motion of approximately forty degrees when the lumbar and thoracic spine are flexed forward. Thirty degrees of this motion is accomplished by the lower spine associated with the lordotic curvature, commonly referred to as "the small of the back". Unless the spine is flexed through its entire range of motion at the proper spot in the spine, the abdominal muscle groups needed to flex the spine are incompletely utilized.

Therefore, the present invention provides a means by which abdominal muscles are exercised by forcing the small of the back against a resistive platform, thereby forcing the spine to flex from a normal resting lordotic curvature through the maximal forward flexure of the spine. Although numerous inventions are ergonomically designed, none found in the prior art use means similar in concept to the present invention to exercise abdominal muscles.

For example, U.S. Pat. No. 2,264,046 issued Nov. 25, 1941 to McClellan describes an exercising platform supported on a solid surface, which is centrally hinged, and having ankle shackles. An adjustable bolster attaches to the platform, intended to fit below the arch of the user's back, over which the user arches exerting force against the ahkle shackles to accomplish a sit-up like maneuver. The bolster only causes a change in the relative amount of body weight which the abdominal muscles must resist to perform a sit-up, and fails to direct the user's efforts at flexing the spine to direct a force through the bolster.

U.S. Pat. No. 5,099,831 issued Mar. 31, 1992 to Freed describes a posture improving device by providing thoracic extension. A flexible membrane in the thoracic area connected by a cable and pulley system to arm rests is projected upward into the thoracic spine stretching certain muscles. Posterior forces must be applied by the arms to the rests to cause the membrane to project into the spine, unlike the operation of the present invention.

Other ergonomic exercise devices seen in the prior art entirely fail to provide resistance mechanisms for exercise of the muscles flexing the spine. U.S. Pat. No. 5,205,804 issued Apr. 27, 1993 to Hall teaches a method for strengthening lower back muscles including positioning the user on a platform having an ankle engaging element and a protrusion over which the user supports the user's pelvis. This apparatus must be used in a prone position and is thus inappropriate for use as a resistive mechanism against the lower spine. U.S. Pat. No. 4,307,880 issued Dec. 29, 1981 to Abram describes a device made up of a elongated resiliently deformable element movable to a position in which it assumes a concave contour and is fixedly retained, so that, when a user reclines therein, a bow-like posture is assumed, assisting the user to learn Yoga positions.

U.S. Pat. No. 4,489,936 issued Dec. 25, 1984 to Dal Monte describes a rigid board for receiving the user's body in various positions and an adjustable lever and fulcrum mechanism attached under the board, whereby the user selectively levers the board with his arms or legs to rock it, utilizing his own weight as a resistive element against the levering action. U.S. Pat. No. 5,232,426 issued Aug. 3, 1993 to Van Straaten describes an exercising machine having support legs and hinged platform movable between an operative state in which the legs define a support stand adjustable to various stationary inclinations and an inoperative collapsed state.

Hinged platforms for various uses are also found in the prior art. German publication No. 0 208 208 published Jan. 1, 1987 by inventor Heinz Kett er describes a training bench with an adjustable backrest for use in weight training. British Patent Application No. 2 192 343 by inventors Mahnke and Sheltra published Jan. 13, 1988 also describes a training bench with an adjustable backrest. U.S. Pat. No. 4,207,635 issued Jun. 17, 1980 to Leroy describes a rest surface which is flat and adapted to receive the body in stretched out position. It is a reversible mat having a swell which, when laid upon in a prone position, causes a kyphosis of the spine in the region of the lumbar vertebrae. None of these devices provide a resistance means to application of force by the lower back.

None of the above inventions and patents, taken either singly or in combination, is seen to describe the instant invention as claimed.

SUMMARY OF THE INVENTION

The present invention relates to an apparatus for exercising the abdominal and other muscles associated with full flexure of the lower and middle spine.

In the preferred embodiment, the invention is made up of four main components: (1) an inclined base, (2) a collapsible platform, (3) pivotally connected support members which elevate the collapsible platform above the base and allow the platform to transform from a resting state to a collapsed state, and (4) a resistance mechanism preventing the collapse of the platform and associated support members and resisting appropriately placed forces exerted by the lower back against the platform.

More particularly, the platform is defined by three sections, a head-end section, a middle section, and a leg-end section, in such a manner that the head-end section and leg-end section can collapse about the middle section throughout a range of positions wherein end-positions are defined by a resting state and a collapsed state. The movement of the platform from resting state to collapsed state can be best visualized by analogy to the effects of a human sitting up from a reclined position on a thin, flexible air mattress floating on a still water surface. As soon as the human sits up, the weight concentrated in the middle of the air mattress causes it to collapse through the middle, causing the top and bottom ends to flip up in front and behind the human.

Similarly, the resting state of the present invention is characterized by a relationship between the middle section and head-end section wherein a level platform portion is closely conformed to the straight back posture of a human having a relaxed or normal lordotic spine. The collapsed state is characterized by a relationship between the middle section and the head-end section wherein an angled platform is formed closely conforming the head-end section and middle section to the posture of a human in which the spine is maximally flexed forward resulting in a backward bowing of the lower spine. A material such as a semi-rigid foam mat may be used which allows flexing of the platform at critical hinge points, yet firmly supports the individual.

The head-end section and leg-end section are supported by a plurality of support members, each such support member having a platform end and a translatable end. Each platform end is pivotally attached to an associated head-end or leg-end section and each translatable end provides a wheel for contact with a convex incline on the base. The translating end of the associated head-end or leg-end section is connected to the middle section by a pivotal member connected to the middle section, effectively forming a generally W-shaped carriage for riding the convex incline of the base. As the wheels move outward and up the convex incline, the middle sinks and the associated support members are forced vertically upward to raise the associated head-end and leg-end sections.

The resistance mechanism resists the collapse of the middle section by providing a force resisting both the force of gravity exerted upon the middle section and the force applied during flexure of the lower spine of the human by the lower spine to said bolster and middle Section. A simple mechanism, such as a spring biased between the associated head-end section and leg-end section support members, is used in the preferred embodiment to resist the outward movement of the wheels. The spring also returns the platform from the collapsed state to the resting state when the force applied to the middle section is released. However, any resistance mechanism attached to the middle section and in communication with the support members may be used, such as electronically controlled sensors in the middle section which sense the force transmitted by the back and control elevators to collapse the platform.

The preferred embodiment provides a horizontal L-shaped platform upon which the human reclines, having the upper legs supported upright in a vertical position. A resilient adjustable belt is provided to strap the waist of the human to the platform. The human can also grasp the belt to aid flexing through the small of the back. However, a second embodiment is also described in which humans with paraplegia of the legs may be seated upright on the invention. This embodiment is mounted with the head-end section and middle section vertically arranged. A selection mechanism controls the platform whereby the leg-end section is disabled and only the head-end section collapses around the middle section.

Accordingly, it is a principal object of the invention to provide a means for exercising the muscles associated with full flexure of the spine.

It is another object of the invention to provide a means for exercising the abdominal muscles by resisting forces applied during flexure of the lower and middle spine of a human by the lower spine to a middle section of collapsible platform.

It is a further object of the invention to provide a collapsible platform having a resistance means against which the lower back may be stretched, ergonomically configured for support of the spine.

Still another object of the invention is to provide an exerciser having means for selectively exercising the abdominal muscles of a human positioned in either an upright or reclined position.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
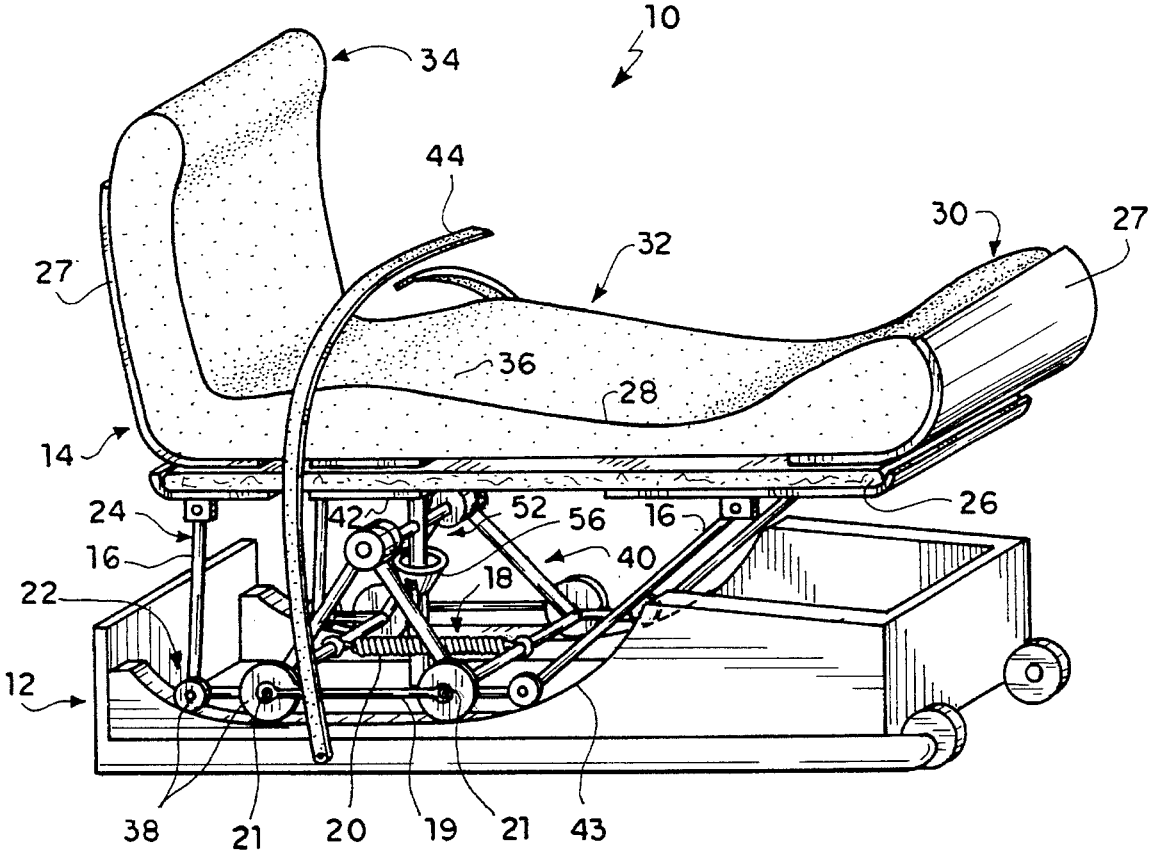
FIG. 1 is an environmental perspective view of the preferred embodiment of the exercise apparatus.
Figure 2:
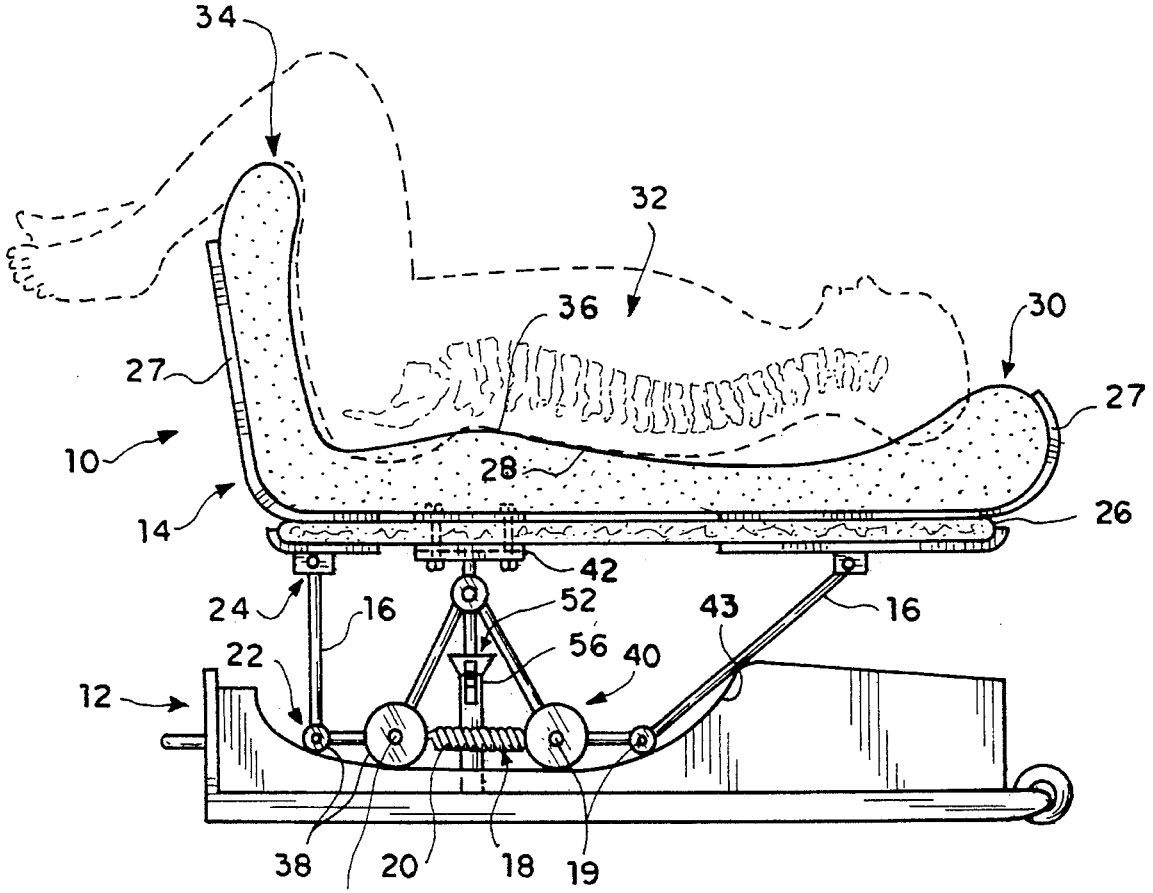
FIG. 2 is a side, elevational view of the exercise apparatus in a resting state.
Figure 3:
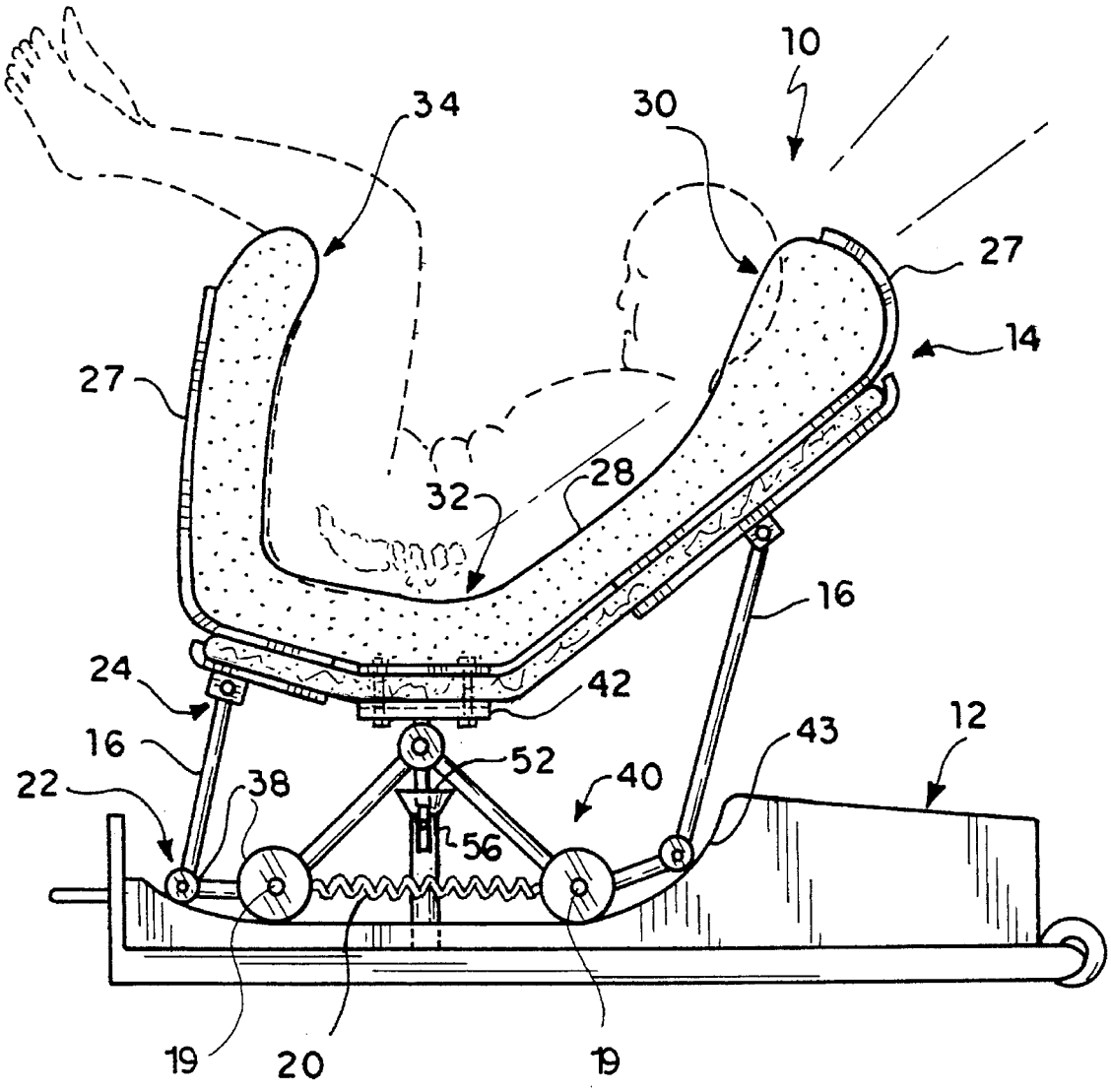
FIG. 3. is a side, elevational view of the exercise apparatus in a collapsed state.

The present invention relates to an apparatus for exercising the abdominal and other muscles associated with full flexure of the lower spine. The structure and operation of the exercise apparatus can be best understood by referring to FIG. 1, FIG. 2, and FIG. 3 alternatively. Referring to FIG. 1 and FIG. 2, the preferred embodiment of the exercise apparatus 10 is shown in a resting state. In contrast, FIG. 3 shows the exercise apparatus 10 in its collapsed state, affected by full flexure of the spine through its forty degrees of range of motion. By comparing FIG. 2 and FIG. 3, the relative changes of position of structure can be observed as they relate to the use of the apparatus as an exerciser.

Each Figure shows an inclined base 12 supporting a collapsible platform 14 defined by three sections, a head-end section 30, a middle section 32, and a leg-end section 34. The platform 14 is made up of a flexible, semi-rigid mat 26, and an ergonomic cushion 28, which slidably rests on the mat 26. The middle section 32 of the cushion 28 has an integrally molded convexly-shaped bolster 36, which semi-rigidly supports the curvature of the human back. The preferred embodiment provides an L-shaped cushion 28 reinforced by rigid members 27 to help maintain the shape, upon which the human legs can be uprightly supported, as shown in FIG. 2. The posture supported allows the back to be comfortably extended at rest and reduces unnecessary movement of the legs during flexion of the back. A resilient adjustable belt 44 is provided to strap the human around the waist to the platform and against which the human can resistively grasp to aid flexing through the small of the back.

As may be more clearly observed in FIG. 2, the platform 14 is pivotally attached to support members 16 which elevate the platform 14 above the base 12. Each of the support members 16 have a platform end 24, pivotally attached to an associated head-end section 30 or leg-end section 34, and a translating end 22. The translating end 22 is in turn pivotally connected by a series of independently articulated members to the middle section 32, supported by a first supporting plate 42, effectively forming a generally W-shaped carriage 40. This carriage 40 rides convex inclines 43 of the base on rotatably mounted wheels 38.

Comparing FIG. 2 to FIG. 3, it can be observed that as the wheels 38 move outward and up the convex inclines 43, the middle section 32 sinks and the associated support members 16 are forced vertically upward to raise the associated head-end and leg-end sections. A resistance mechanism 18, comprising a spring 20 attached to the carriage 40, prevents the collapse of the platform 14 by resisting outward motion of the carriage components.

In the resting state, the spring 20 is of sufficient tension to prevent collapse of the sections. As a human reclines on the platform 14, the weight of the body is evenly distributed over the ergonomically supportive platform 14. Upon flexing, the tension of the spring 20 is overcome and allows the platform 14 to collapse. Removal of the force caused by flexing from the middle section 32 permits the return force of the spring 20 to return the platform 14 from the collapsed state to the resting state. However, it is again noted that any resistance mechanism attached to the middle section and in communication with the support members may be used, such as variably resistive or adjustable elastic or weight elements, piston and cylinder assemblies, or an electronically controlled resistance mechanisms which sense the force transmitted by the back and controls the collapse of the platform. Moreover, to provide variable resistance in the preferred embodiment as shown in FIG. 1, resistive Bands 19 are looped over hooks 21, or attached by any other suitable releasable fasteners, located on the center of each of opposing wheels 38. Multiple bands 19 can be selectively added to variably increase resistance against which the lower and middle back exercises. The resistance of the bands 19 is additive to the resistance of the spring 20.

Figure 4:
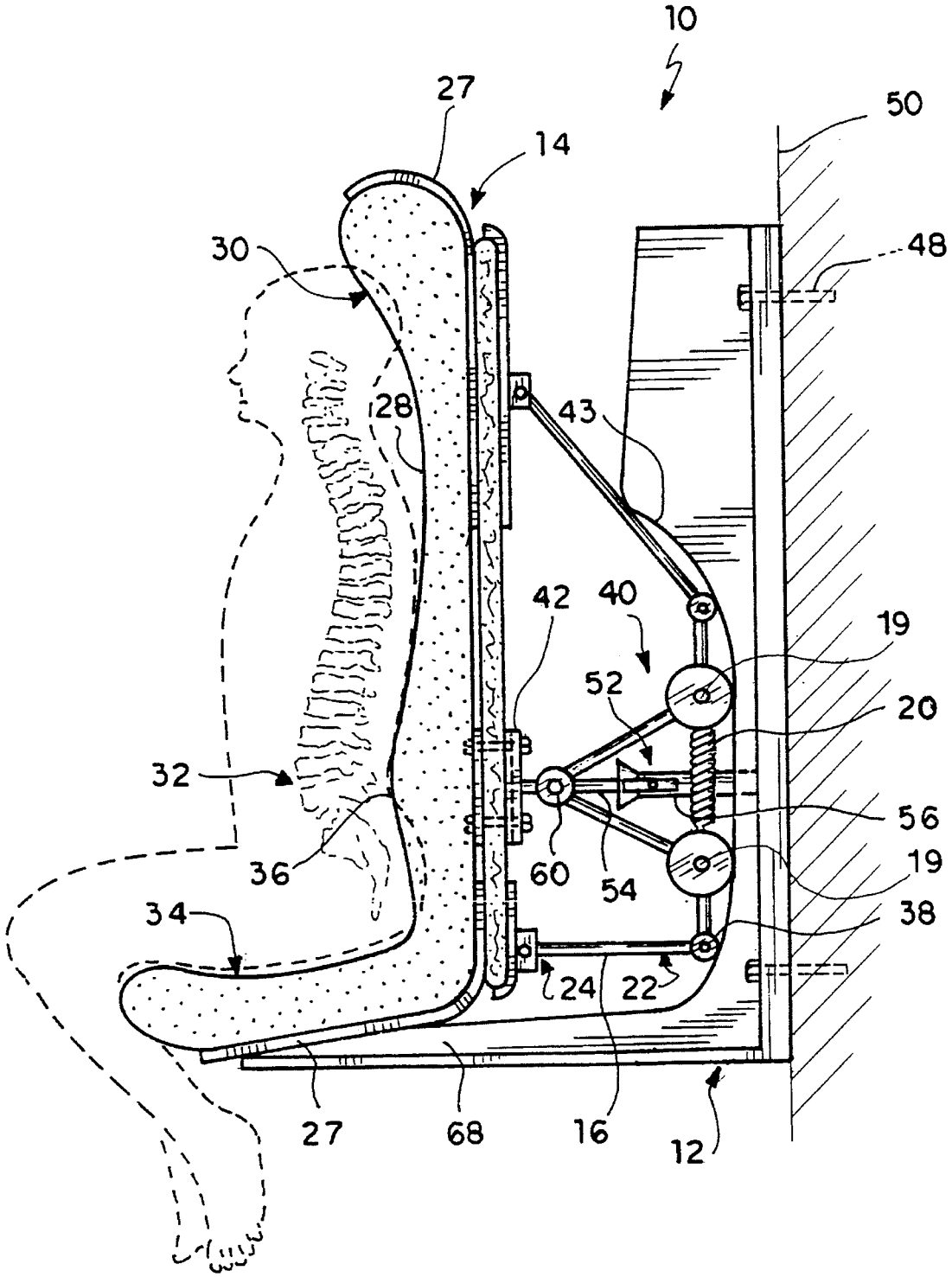
FIG. 4 is a side, elevational view of a second embodiment of the exercise apparatus in a resting state.

Referring now to FIG. 4, a second embodiment is also described in which a human may be seated upright on the invention, particularly suited to human conditions in which the legs are disabled. This embodiment is mounted to a vertical support 50 by a mounting means 48, such as bolts passing through an aperture in the base 12, with the head-end section 30 and middle section 32 vertically arranged.

Figure 5:
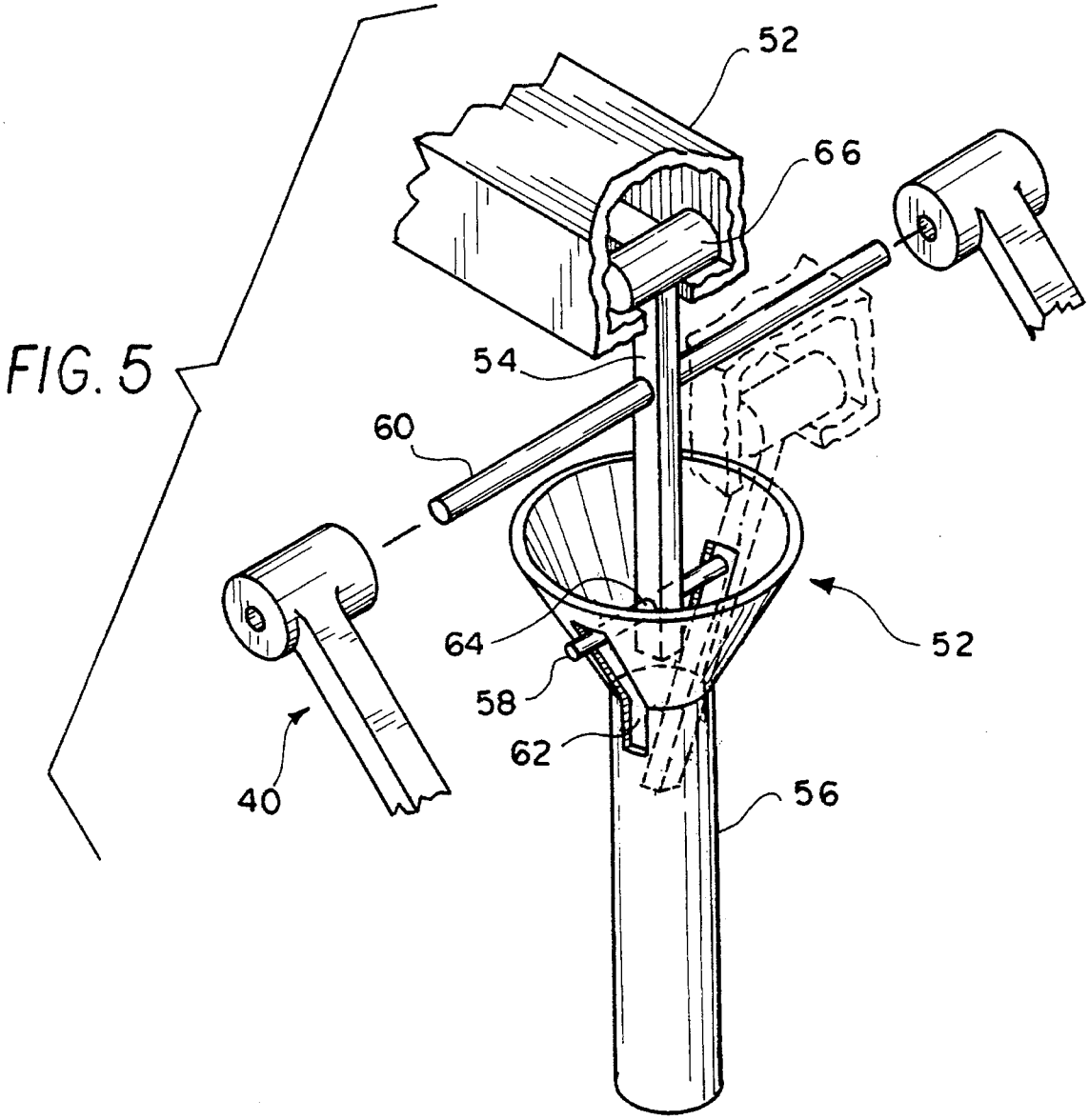
FIG. 5 is an isolated, partly exploded, perspective view of the selection mechanism for disabling the leg-end section of exercise apparatus.

A selection mechanism 52, appropriate for use with both the preferred embodiment as shown in FIG. 2 and second embodiment as shown in FIG. 4, is isolated in FIG. 5. The selection mechanism 52 allows the leg-end section 34 to be disabled so that only the head-end section 30 collapses around the middle section 32 only when the exercise apparatus is orientation as shown in the second embodiment in FIG. 4.

As can be understood by comparing the positions of the selection mechanism 52 oriented vertically as shown in FIG. 3 to the selection mechanism 52 oriented horizontally as shown in FIG. 4. A reciprocating member 54 has perpendicularly oriented arms 60 for pivotal engagement of the carriage 40 and an enlarged head 66, which is seated in a channel defined by the support plate 42. When the reciprocating member 54 is oriented vertically, as shown in FIG. 2, an entrapping funnel 56 prevents pendular motion of the reciprocating member 54. A removable pin 58 is passed through a slot 62 in the funnel 56 and an aperture 64 in registry defined by the reciprocating member 54 to insure this condition. For sake of clarity, FIG. 5 shows the pin 58 oriented in plane parallel to the length of the platform; however, for ease of removal of pin 58, slot 62 and pin 58 may be arranged perpendicular to this plane, as suggested by FIG. 1.

When the reciprocating member 54 is oriented horizontally, as shown in FIG. 4, and the pin 58 is removed, the reciprocating member is able to swing free of the slot 62 and funnel 56. Once freed and upon seating of the human on the leg-end section 34, the weight of the human anchors the leg-end section 34 to an elongated shelf 68, thereby effectively anchoring movement of the support member 16 associated with the leg-end section 34. However, upon application of the force against the middle section 32, the support plate 42 affixed to the middle section 32 will move towards the base and upwardly relative to the shelf 68, as shown by the broken lines in FIG. 5. This motion causes the carriage 40 associated with the head-end section 30 to pivot about the arms 60 and the support member 16 to extend causing the collapse the head-end section 30. During the process, the reciprocating member 54 is forced at an angle relative to cylindrical axis of the funnel 56, which requires clearance of the pin 58 by the slot 62 and the free end of the reciprocating member 54 by the funnel 56. The spring 20 is also tensioned against the stationary carriage 40 associated with the leg-end section 34 and returns the platform 14 from the collapsed state to the resting state upon release of the force against the middle section It is to be understood that the present invention is not limited to the embodiments described above, but encompasses any and all embodiments within the scope of the following claims.

I claim:

1. An exercise apparatus for exercising abdominal muscles of a human comprising:

a base; having an inclined surface a platform having a head-end section, a leg-end section and a middle section, said platform being collapsible at said middle section and wherein said end-positions are defined by a resting state, wherein said middle section and head-end section define a level platform portion having said head-end section and middle section provided in relative positions to each other to accommodate said platform in close conformity to a back of the human in a posture having a relaxed lordotic spine, and a collapsed state, wherein said middle section and said head-end section define an angled platform having said head-end section at an angle relative to said middle section to accommodate said platform in close conformity with the back of the human upon said platform in a posture wherein the spine is maximally flexed forward;

a deformable cushioning means, having a first end and a second end, dimensioned and configured to have a convex bolster integrally provided between said first end and said second end, said bolster being dimensioned and configured to generally fit the curvature defined by the lower lordotic spine, said cushioning means further dimensioned and configured to closely fit and rest upon said platform;

support means for elevating said platform above said base, said support means further comprising a plurality of support members, a first support member of said plurality of support members having a first platform end and a first translating end, said first support member being pivotally attached by said first platform end to said head-end section and a second support member of said plurality of support members, having a second platform end and a second translating end, said second support member being pivotally attached to said leg-end section at said second platform end, said first translating end and said second translating being end in communication with said inclined surface of said base member to guide said translating ends along said inclined surface thereby causing said platform to pass throughout a range of inclined positions;

a resistance means operably attached to and in communication with said middle section in a manner so as to permit movement of said platform from said resting state through said range of positions upon application of a force created during flexure of the lower and middle spine of the human to said bolster and middle section, said resistance means further operably attached to and in communication with said first translating end and said second translating end in a manner to allow pivotal movement of said head-end section and said leg-end section inwardly about said middle section throughout said range of positions upon movement of said middle section;

whereby the curvature of the lordotic spine of the human is supported by said bolster during said resting state, and whereby further the human may exercise abdominal muscles by repeated application of the force caused by flexure of the lower and middle spine against said bolster, middle section and resistance means to achieve said range of positions of said exercise apparatus.

2. The exercise apparatus according to claim 1, further comprising a restraining means for providing restraint against a body part of the human, said restraining means being affixed to said base.

3. The exercise apparatus according to claim 2, wherein said restraining means is an adjustable belt.

4. The exercise apparatus according to claim 3, wherein said belt is resilient and adapted to maintain tension against the human positioned on said platform in the collapsed state.

5. The exercise apparatus according to claim 1, wherein said platform is dimensioned and configured to have a generally L-shaped configuration during said resting state, wherein said leg-end section is affixed at an angle relative to said middle section to accommodate a human upon said platform in a posture wherein the legs are brought into relation with said spine to resemble a sitting posture.

6. The exercise apparatus according to claim 5, further including mounting means attached to said base for mounting said exercise apparatus to a vertical support to accommodate a human upon said platform in a sitting posture.

7. The exercise apparatus according to claim 6, further including selection means for selectively actuating said second support member, whereby said leg-end member is disabled and said head-end section is enabled to move consistent with the positions of said range of positions.

8. The exercise apparatus according to claim 1, wherein each of said plurality of support members is an elongated rod of predetermined length and each said first translating end and said second translating end is attached to a translating member, said translating member travels long said incline and is guided in a manner to cause said platform to pass through said range of inclined positions, and wherein further said resistance means is a spring operably attached in a manner to bias said first support member against said second support member and to resist said force passed through said middle section to said spring, whereby collapse of said platform is resisted throughout said range of positions and said spring returns said platform to a resting state upon release of said force against said middle section.

9. An exercise apparatus for exercising abdominal muscles of a human comprising:

a base;

an ergonomic platform for support of a human having a lordotic spine, said platform dimensioned and configured to include a head-end section, a leg-end section and a middle section, said head-end section and said leg-end section being collapsible at said middle section and wherein said end-positions are defined by a resting state, wherein said middle section and head-end section define a level platform portion having said head-end section and middle section provided in relative positions to each other to accommodate upon said platform the human in a posture having a relaxed lordotic spine, and a collapsed state, wherein said middle section and said head-end section define an angled platform having said head-end section and middle section angled relative to each other to accommodate the human upon said platform in a posture wherein the spine is maximally flexed forward;

a convex bolster integrally provided between said head-end section and said leg-section, said bolster dimensioned and configured to generally fit the curvature defined by the relaxed, lower lordotic spine of the human;

support means for elevating said platform above said base, said support means further comprising a plurality of support members, a first support member of said plurality of support members having a first platform end and a first translating end, said first support member being pivotally attached by said first platform end to said head-end section and a second support member of said plurality of support members, having a second platform end and a second translating end, said second support member being pivotally attached to said leg-end section of said second platform end said first translating end and said second translating end being in communication with said inclined surface of said base member to guide said translating ends along said inclined surface thereby causing said platform to pass throughout a range of inclined positions and a second support member of said plurality of support members pivotally attached to said leg-end section in a manner so as to be capable of pivotally adjusting said platform through said range of positions;

a resistance means operably attached to and in communication with said first support member and said second support member in a manner so as to resist collapse of said head-end section and said leg-end section inwardly about said middle section defining said collapsed state, said resistance means being further operably attached and in communication with said middle section in a manner so as to permit movement of said platform from said resting state through said range of positions upon application of a force created during flexure of the lower and middle spine of the human to said bolster and middle section; and, a restraining means for providing restraint against a body part of the human, said restraining means being affixed to said base;

whereby the curvature of the lordotic spine of the human is supported by said bolster during said resting state, and whereby further the human may exercise abdominal muscles by repeated application of the force caused by flexure of the lower and middle spine against said bolster, middle section and resistance means to achieve said range of positions of said exercise apparatus.

10. The exercise apparatus according to claim 9, further comprising a removable cushioning means for cushioning said platform, wherein said cushioning means is deformable throughout said range of positions.

11. The exercise apparatus according to claim 9, wherein said restraining means is an adjustable belt.

12. The exercise apparatus according to claim 11, wherein said belt is resilient.

13. The exercise apparatus according to claim 9, wherein said platform is dimensioned and configured to have a generally L-shaped configuration during said resting state, wherein said leg-end section is affixed at an angle relative to said middle section to accommodate a human upon said platform in a posture wherein the legs are brought into relation with said spine to resemble a sitting posture.

14. The exercise apparatus according to claim 13, further including mounting means attached to said base for mounting said exercise apparatus to a vertical support to accommodate a human upon said platform in a sitting posture.

15. The exercise apparatus according to claim 9, further including selection means for selectively actuating said second support member, whereby said leg-end member is disabled and said head-end section is enabled to move consistent with said range of positions.

16. The exercise apparatus according to claim 9, wherein said support members are elongated rods of predetermined lengths and each said first translating end and said second translating end is attached to a translating member, said translating member travels along said incline and is guided in a manner to cause said platform to pass through said range of inclined positions, and wherein further said resistance means is a spring operably attached in a manner to bias said first support member against said second support member and to resist said force through said middle section to said spring, whereby collapse of said platform is resisted throughout said range of positions and said spring returns said platform to a resting state upon release of said force from said middle section.

17. An exercise apparatus for exercising abdominal muscles of a human comprising:

a inclined base;

mounting means attached to said base for selectively mounting said exercise apparatus to a vertical support to accommodate a human upon said platform in a sitting posture;

a restraining means attached to said base for stationary resistance against a force applied by a human using said exercise apparatus while exercising to said exercise apparatus;

a platform having a head-end section, a leg-end section and a middle section, said platform being dimensioned and configured to have a generally L-shaped configuration wherein said leg-end section is affixed at an angle relative to said middle section to accommodate a human upon said platform in a posture wherein the legs are brought into relation with said spine to resemble a sitting posture, said platform further being collapsibly attached about said middle section in such a manner that said platform is transformable throughout a range of positions wherein end-positions are defined by a resting state, wherein said middle section and head-end section define a level platform portion having said head-end section and middle section provided in relative positions to each other to accommodate said platform in close conformity to a back of the human in a posture having a relaxed lordotic spine, and a collapsed state, wherein said middle section and said head-end section define an angled platform having said head-end section at an angle relative to said middle section to accommodate said platform in close conformity with the back of the human upon said platform in a posture wherein the spine is maximally flexed forward;

a deformable cushioning means, having a first end and a second end, dimensioned and configured to have convex bolster integrally provided between said first end and said second end, said bolster dimensioned and configured to generally fit the curvature defined by the lower lordotic spine, said cushioning means further dimensioned and configured to closely fit and rest upon said platform;

support means for elevating said platform above said base, said support means further comprising a plurality of support members, each of said plurality of support members being an elongated rod of predetermined length and including a first support member, having a first platform end and a first translating end, pivotally attached by said first platform end to said head-end section and a second support member, having a second platform end and a second translating end, pivotally attached to said leg-end section, said first translating end and said second translating end each being operably attached to a translating member for traveling upon said inclined base, said inclined base having an associated incline upon which an associated translating member is guided, in a manner to cause said platform to pass through said range of positions and said first translating end and said second translating end each being further operably attached to said middle section in a manner to allow pivotal movement of said head-end section and said leg-end section inwardly about said middle section throughout said range of positions upon movement of said middle section;

a spring operably attached in a manner to bias said first support member against said second support member and to resist said force passed through said middle section to said spring and said spring operably attached to and in communication with said middle section in a manner to permit movement of said platform from said resting state through said range of positions upon application of a force created during flexure of the lower and middle spine of the human to said bolster and middle section; and selection means for selectively actuating said second support member, whereby said leg-end member is disabled and said head-end section is enabled to move consistent with the positions of said range of positions;

whereby collapse of said platform is resisted throughout said range of positions by said spring, whereby further said spring returns said platform to a resting state upon release of said force against said middle section, whereby further the curvature of the lordotic spine of the human is supported by said bolster during said resting state, and whereby further the human may exercise abdominal muscles by repeated application of the force caused by flexure of the lower and middle spine against said bolster, middle section and spring to achieve said range of positions of said exercise apparatus.

* * * * *